US010376901B2

(12) United States Patent
Smolko-Schvarzmayr et al.

(10) Patent No.: US 10,376,901 B2
(45) Date of Patent: Aug. 13, 2019

(54) USE OF BRANCHED ALCOHOLS AND ALKOXYLATES THEREOF AS SECONDARY COLLECTORS

(71) Applicant: Akzo Nobel Chemicals International B.V., Arnhem (NL)

(72) Inventors: Natalija Smolko-Schvarzmayr, Hjälteby (SE); Anders Klingberg, Henån (SE); Elisabeth Henriksson, Kode (SE); Henrik Nordberg, Stenungsund (SE)

(73) Assignee: AKZO NOBEL CHEMICALS INTERNATIONAL B.V., Arnhem (NL)

( * ) Notice: Subject to any disclaimer, the term of this patent is extended or adjusted under 35 U.S.C. 154(b) by 0 days.

(21) Appl. No.: 15/511,138

(22) PCT Filed: Sep. 15, 2015

(86) PCT No.: PCT/EP2015/071003
§ 371 (c)(1),
(2) Date: Mar. 14, 2017

(87) PCT Pub. No.: WO2016/041916
PCT Pub. Date: Mar. 24, 2016

(65) Prior Publication Data

US 2017/0252753 A1 Sep. 7, 2017

(30) Foreign Application Priority Data

Sep. 18, 2014 (EP) ..... 14185418

(51) Int. Cl.
*B03D 1/02* (2006.01)
*B03D 1/008* (2006.01)
(Continued)

(52) U.S. Cl.
CPC ..... *B03D 1/021* (2013.01); *B03D 1/008* (2013.01); *B03D 1/01* (2013.01); *B03D 1/012* (2013.01);
(Continued)

(58) Field of Classification Search
CPC ..... B03D 1/021; B03D 1/012; B03D 1/01; B03D 1/014; B03D 1/008; B03D 2201/02; B03D 2203/06
(Continued)

(56) References Cited

U.S. PATENT DOCUMENTS 4,198,297 A 4/1980 Valdes-Krieg et al.
4,358,368 A * 11/1982 Hellsten ..... B03D 1/01 209/166
(Continued)

FOREIGN PATENT DOCUMENTS

AU 44764/79 9/1979
CA 1280520 12/1991
(Continued)

OTHER PUBLICATIONS

EIC structure search elected species Oct. 20, 2017.*
(Continued)

*Primary Examiner* — Pamela H Weiss
(74) *Attorney, Agent, or Firm* — Matthew J. DeRuyter

(57) ABSTRACT

The present invention relates to the use of branched fatty alcohol-based compounds selected from the group of fatty alcohols with 12-16 carbon atoms having a degree of branching of 1-3, and their alkoxylates with a degree of ethoxylation of up to 3, as secondary collectors for the froth flotation of non-sulfidic ores, in combination with a primary collector selected from the group of amphoteric and anionic surface active compounds.

7 Claims, 2 Drawing Sheets

A - Exxal 13+1.5EO (invention); B - Marlipal O +1.5EO (invention); C – Berol259 (comparative), D - Safol 23+1.5EO (comparative); E - Alfol 12/14S+1.5EO (comparative)).

(51) Int. Cl.
*B03D 1/01* (2006.01)
*B03D 1/014* (2006.01)
*B03D 1/012* (2006.01)

(52) U.S. Cl.
CPC ..... *B03D 1/014* (2013.01); *B03D 2201/02* (2013.01); *B03D 2203/06* (2013.01)

(58) Field of Classification Search
USPC ..... 209/162, 165–167
See application file for complete search history.

(56) References Cited

U.S. PATENT DOCUMENTS

| | | | | | |
|---|---|---|---|---|---|
| 4,545,898 | A * | 10/1985 | Hellsten | B03D 1/008 209/166 | |
| 4,789,466 | A | 12/1988 | von Rybinski et al. | | |
| 4,790,931 | A | 12/1988 | Koester et al. | | |
| 4,814,070 | A | 3/1989 | Koester et al. | | |
| 4,828,687 | A * | 5/1989 | Hellsten | B03D 1/011 209/166 | |
| 5,536,884 | A | 7/1996 | Stoeckigt et al. | | |
| 5,540,336 | A * | 7/1996 | Schreck | B03D 1/008 209/166 | |
| 5,837,099 | A | 11/1998 | Borchardt | | |
| 6,001,790 | A | 12/1999 | Schmitt et al. | | |
| 6,248,708 | B1 | 6/2001 | Merz et al. | | |
| 6,963,014 | B1 * | 11/2005 | Zeller | C07C 29/141 568/909 | |
| 6,974,852 | B2 | 12/2005 | Stanger et al. | | |
| 7,183,446 | B2 * | 2/2007 | Zeller | C07C 29/16 568/876 | |
| 7,335,235 | B2 | 2/2008 | Ruland et al. | | |
| 7,954,643 | B2 * | 6/2011 | Eisenhuth | B03D 1/01 209/166 | |
| 9,561,512 | B2 * | 2/2017 | Bittner | B03D 1/01 | |
| 2006/0018855 | A1 | 1/2006 | Batista et al. | | |
| 2007/0071665 | A1 * | 3/2007 | Eisenhuth | B03D 1/01 423/157.2 | |
| 2011/0260101 | A1 * | 10/2011 | Rittig | B01F 17/0092 252/182.12 | |
| 2013/0231508 | A1 * | 9/2013 | Maynard | C07C 43/11 568/618 | |
| 2014/0262974 | A1 * | 9/2014 | Kouznetsov | B03D 1/02 209/166 | |

FOREIGN PATENT DOCUMENTS

| | | | | |
|---|---|---|---|---|
| DE | 1162305 | | 2/1964 | |
| DE | 2418263 | A1 | 11/1975 | |
| DE | 4207109 | A1 | 9/1993 | |
| DE | 4225909 | | 2/1994 | |
| DE | 10218752 | A1 | 11/2003 | |
| DE | 10243361 | A1 | 4/2004 | |
| EP | 0 270 933 | A2 | 6/1988 | |
| EP | 0 687 726 | A1 | 12/1995 | |
| EP | 0 946 697 | B1 | 10/2002 | |
| EP | 1 621 181 | B1 | 9/2010 | |
| EP | 1 501 775 | B1 | 12/2010 | |
| EP | 1 694 906 | B1 | 2/2013 | |
| EP | 2 650 352 | A1 | 10/2013 | |
| SE | 409 291 | | 8/1979 | |
| WO | 97/48850 | A1 | 12/1997 | |
| WO | 00/50560 | A1 | 8/2000 | |
| WO | 2004/052815 | A1 | 6/2004 | |
| WO | 2005/046878 | A2 | 5/2005 | |
| WO | 2005/113687 | A1 | 12/2005 | |
| WO | WO-2012139985 | A2 * | 10/2012 | B03D 1/01 |
| WO | 2015/000931 | A2 | 1/2015 | |
| WO | 2016/041916 | A1 | 3/2016 | |
| WO | 2017/162563 | A2 | 9/2017 | |

OTHER PUBLICATIONS

European Search Report issued in EP Application No. 14185418.2 dated Mar. 31, 2015.
International Search Report and Written Opinion for PCT/EP2015/071003 dated Nov. 26, 2015.
International Preliminary Report o Patentability for PCT/EP2015/071003, dated Dec. 23, 2016.
Shell: "Neodol 25-3 Primary Alcohol Ethoxylate V2634 Derivatives Data Sheet," Oct. 1, 2005.
Shell: Objective Branching and Carbon Number Type in Detergent Range Alcohols*, Sep. 16, 2009.
Shell: "Typical Distributions of Neodol™ Ethoxylate Adducts", Nov. 5, 2009.
Sasol: "Isotridecanol Ethoxylates Marlipal® 013, Sasol Olefins & Surfactants," Dec. 31, 2004.
Sasol: "Marlipal® 013 Alcohol Technical Data Sheet", Nov. 12, 2015.
BASF, Lutensol® TO Types, Technical Information, Feb. 28, 1997, 15 pages, XP055305778.
Shell Chemicals, NEODOL 1, Linear Primary Alcohol, Oct. 31, 2005, 2 pages, XP55413830.
Shell Chemicals, NEODOL 45-7, Primary Alcohol Ethoxylate, V2459, Derivatives Data Sheet, Oct. 1, 2005, 2 pages, XP055414581.

* cited by examiner

A - Exxal 13+1.5EO (invention); B - Marlipal O +1.5EO (invention); C – Berol259 (comparative), D - Safol 23+1.5EO (comparative); E - Alfol 12/14S+1.5EO (comparative)).

USE OF BRANCHED ALCOHOLS AND ALKOXYLATES THEREOF AS SECONDARY COLLECTORS

This application is a national stage filing under 35 U.S.C. § 371 of PCT/EP2015/071003, filed Sep. 15, 2015, which claims priority to European Patent Application No. 14185418.2, filed Sep. 18, 2014, the contents of which are each incorporated herein by reference in their entireties.

FIELD OF INVENTION

The present invention relates to the use of branched alcohols and/or their alkoxylates as secondary collectors for the froth flotation of non-sulfidic ores, especially phosphate ores, in combination with a primary collector which is an anionic or an amphoteric surface active compound.

BACKGROUND OF THE INVENTION

Phosphate rocks contain calcium phosphate minerals largely in the form of apatite, usually together with other minerals, e.g. silicate minerals and carbonate minerals, such as calcite. Apatite is a generic name for a group of calcium phosphate minerals also containing other elements or radicals, such as fluorapatite, chlorapatite, hydroxylapatite, carbonate-rich fluorapatite and carbonate-rich hydroxylapatite.

It is well-known to separate the valuable phosphate minerals from the gangue by using a froth flotation process where the phosphate minerals are enriched in the float.

Good performance in a froth flotation process is achieved by a combination of, on the one hand, a good separation of the valuable mineral from the gangue by using a selective collector and, on the other hand, the froth characteristics. The froth characteristics include both the height and the stability of the froth. It is important in the flotation process that the froth collapses as soon as possible after the air supply is stopped, since this is directly connected to the flotation performance. A too stable froth will cause both entrainment of particles and froth product pumping problems. Entrainment, especially on a large scale, will result in decreased selectivity (grade, recovery). Problems with froth product pumping will make a process of flotation technically impossible.

Collector performance may be improved by using collector combinations of a primary (main) collector and a secondary collector (co-collector). In this document the term "collector composition" shall be used to describe compositions containing both a primary and a secondary collector.

For many decades secondary collectors have been used together with primary ionic collectors in salt-type mineral flotation to improve the performance of the primary collector. Nonylphenol ethoxylates have been the dominating nonionic surfactant used as a co-collector in a combination with sarcosine-type primary collectors in selective flotation of apatite from calcite-containing ores.

SE 409291 discloses a method for foam flotation of calcium phosphate-containing minerals, using an amphoteric surface-active compound as the primary collector. The primary collector's flotating ability may further be strengthened by the presence of a secondary collector, which is described as a polar, water-insoluble, hydrophobic substance having affinity to the mineral particles that have been coated by the primary collector. Examples of the polar components are e.g. water-insoluble soaps, such as calcium soaps, water-insoluble surface-active alkylene oxide adducts, organic phosphate compounds, such as tributyl phosphate, and esters of carbonic acids, such as tributyl ester of nitrilotriacetic acid. In the working examples nonylphenol that has been reacted with two moles of ethylene oxide was used as the secondary collector.

The secondary collector disclosed in SE'291 still is considered a good choice in treating ores, as it provides for an excellent mineral recovery at a $P_2O_5$ grade of higher than 30%. However, due to environmental concerns, an intense search for a replacement of nonylphenol ethoxylates has been ongoing for a long time.

EP 0 270 933 A2 discloses mixtures as collectors for flotation of non-sulfidic ores that contain an alkyl or alkenyl polyethylene glycol ether that is end capped with a hydrophobic group and an anionic tenside. The end capped alkyl or alkenyl polyethylene glycol ether in embodiments is based on a fatty alcohol, preferably a C12 to C18 fatty alcohol. In comparative Examples in EP 0 270 933 also non-end-capped fatty alcohols are used together with anionic tensides. In EP 0 270 933 no disclosure is made of using fatty alcohols having a degree of branching of 1 to 3, and the molecules exemplified in the document, though environmentally more friendly than nonylphenol ethoxylates, do not perform as well as these nonylphenol ethoxylates as collectors for flotation of non-sulfidic ores in terms of mineral recovery at the desired high grades.

Thus, there is still a need for secondary collectors having a better environmental profile than nonylphenol ethoxylates that perform equally well.

SUMMARY OF THE INVENTION

It is an object of the present invention to provide a secondary collector, which will work in combination with a primary collector of the amphoteric or anionic type, for the froth flotation of non-sulfidic ores to recover oxides, carbonates, phosphates and other salt-type minerals, especially calcium phosphate-containing minerals, wherein said collector mixture is very efficient in recovering apatite in the presence of silicate and/or carbonate minerals, and wherein said secondary collector has a better environmental profile than nonylphenol ethoxylates.

Now it has surprisingly been found that the use of branched fatty alcohols with 12-16, preferably 12-15, carbon atoms having a degree of branching of 1-3, and their alkoxylates with a degree of ethoxylation of up to 3, preferably up to 2.8, more preferably up to 2.5, even more preferably up to 2.3 and most preferably up to 2, contributes to improved performance in froth flotation of non-sulfidic ores, with an amphoteric or anionic surface-active compound as the primary collector, especially for froth flotation of calcium phosphate-containing minerals.

The more environmentally friendly branched fatty compounds of the present invention surprisingly perform at least as well as the state of the art nonyl phenol ethoxylates in recovering minerals from ores, and better than collector mixtures that have a similar environmental profile as described in the prior art.

DETAILED DESCRIPTION OF THE INVENTION

Figure 1:
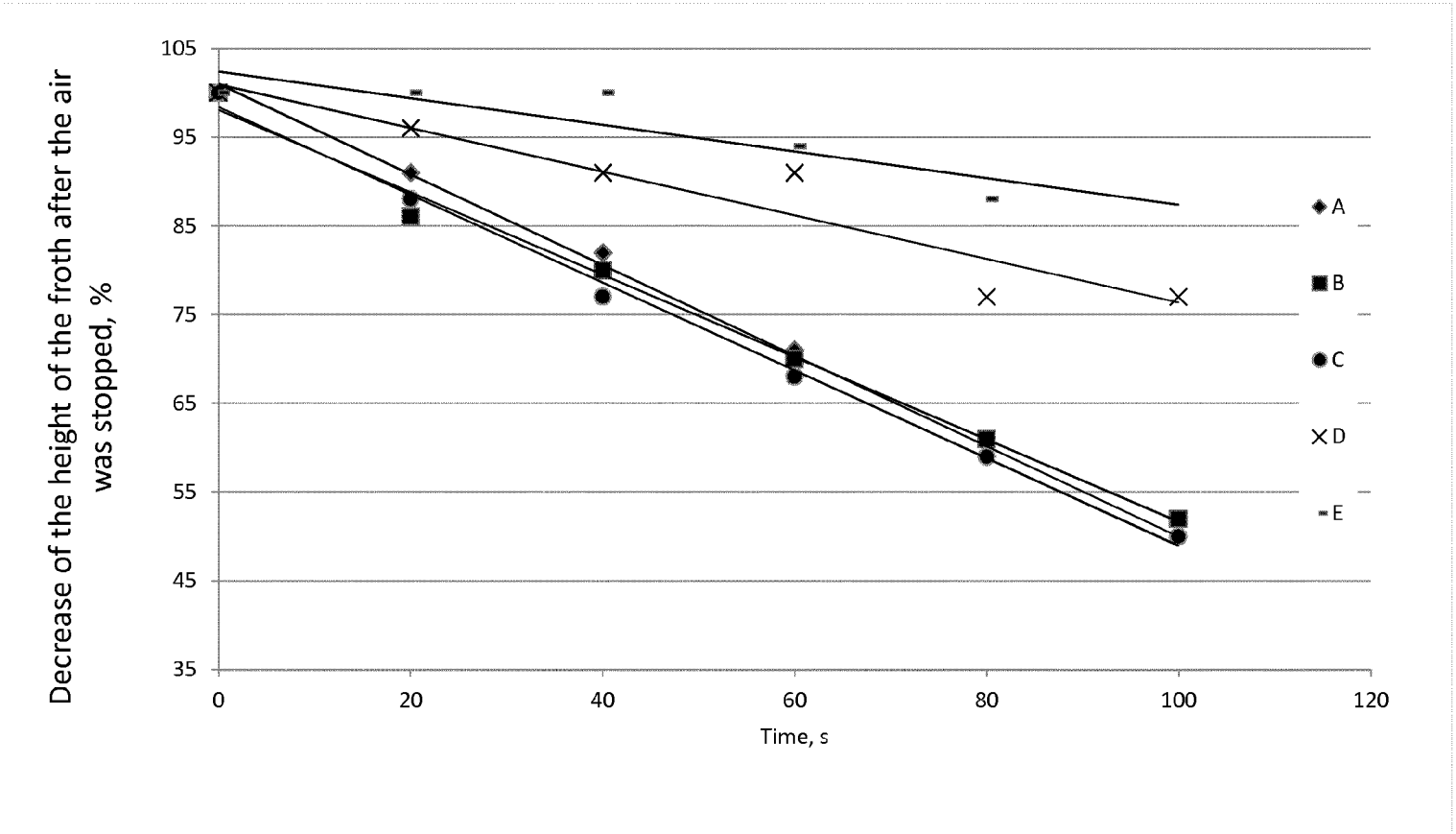
FIG. 1 shows the results from evaluating the stability of froth

In one aspect, the invention relates to the use of branched fatty alcohols with 12-16, preferably 12-15, carbon atoms having a degree of branching of 1-3, and/or their alkoxylates with a degree of ethoxylation of up to 3, preferably up to 2.8, more preferably up to 2.5, even more preferably up to 2.3 and most preferably 2, as secondary collectors for the froth flotation of non-sulfidic ores, especially to recover calcium phosphate-containing minerals, such as apatite, in combination with a primary collector which is an amphoteric or anionic surfactant. Examples of other valuable minerals that may be recovered using this combination of primary and secondary collector include scheelite, fluorspar, calcite and dolomite.

By "the degree of branching" (DB) as used herein is meant the total number of methyl groups present on the alkyl or alkenyl chain of the alcohol or alkoxylate thereof, minus one.

The molecular formula of the secondary collectors is suitably $$R—O—(PO)_x(EO)_y(PO)_zH \quad (I),$$

wherein R is an alkyl or alkenyl group having 12-16, preferably 12-15, carbon atoms, and where said alkyl or alkenyl group has a degree of branching of 1-3; PO is a propyleneoxy unit and EO is an ethyleneoxy unit; x is a number 0-2, preferably 0, y is a number 0-3, preferably 0-2.8, more preferably 0-2.5, even more preferably 0-2.3 and most preferably 0-2, and z is a number 0-2, preferably 0.

As is evident from formula (I), the alcohols as such, as well as their alkoxylates, may be used as secondary collectors. The alkoxylated products according to formula (I) may be produced by procedures well-known in the art by reacting the appropriate starting alcohol with ethylene oxide, or propylene oxide and ethylene oxide, in the presence of a suitable catalyst, e.g. a conventional basic catalyst, such as KOH, or a so-called narrow range catalyst (see e.g. *Nonionic Surfactants: Organic Chemistry in Surfactant Science Series* volume 72, 1998, pp 1-37 and 87-107, edited by Nico M. van Os; Marcel Dekker, Inc). If both propylene oxide and ethylene oxide are used, the alkoxides may be added as blocks in either order, or may be added randomly. The products obtained from reaction with only ethylene oxide are the most preferred.

The primary collectors used in the froth flotation according to the present invention may be either amphoteric or anionic surface-active compounds. Below some examples of formulae for the primary collectors are given, but these should only be considered as suitable for the invention, and are not to be regarded as limiting.

In one embodiment the primary collector for the above-mentioned froth flotation procedure has the formula (II)

(II)

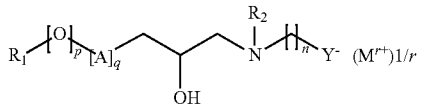

wherein $R_1$ is a hydrocarbyl group with 8-22, preferably 12-18, carbon atoms; A is an alkyleneoxy group having 2-4, preferably 2, carbon atoms; p is a number 0 or 1; q is a number from 0 to 5, preferably 0; $R_2$ is a hydrocarbyl group having 1-4 carbon atoms, preferably 1, or $R_2$ is the group

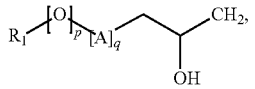

wherein $R_1$, A, p and q have the same meaning as above; $Y^-$ is selected from the group consisting of $COO^-$ and $SO_3^-$, preferably $COO^-$; n is a number 1 or 2, preferably 1; M is a cation, which may be monovalent or divalent, and inorganic or organic, and r is a number 1 or 2. The primary collector may also be used in its acid form, where the nitrogen is protonated and no external cation is needed.

The compounds according to formula (II) can easily be produced in high yield from commercially available starting materials using known procedures. U.S. Pat. No. 4,358,368 discloses some ways to produce the compounds where $R_1$ is a hydrocarbyl group with 8-22 carbon atoms (col 6, line 9-col 7, line 52), and in U.S. Pat. No. 4,828,687 (col 2, line 2-col 2, line 31) compounds where $R_2$ is

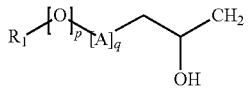

attached to the compound of formula (II) via the methylene group, are described.

In another embodiment the primary collector has the formula (III)

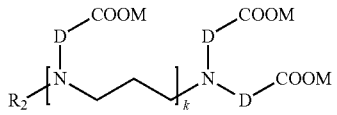

wherein $R_2$ is a hydrocarbyl group with 8-22, preferably 12-18, carbon atoms, D is $—CH_2—$ or $—CH_2CH_2—$, k is 0-4, preferably 0-3, and most preferably 0-2, and M is hydrogen or a cation, such as sodium or potassium.

These products are well known and are produced commercially by methods well known in the art. The products where D is $—CH_2—$ are prepared by the reaction between a fatty amine and chloroacetic acid or its salts, and the products where D is $—CH_2CH_2—$ are prepared by the reaction between a fatty amine and acrylic acid or esters thereof, in the latter case the reaction is followed by hydrolysis.

In a further embodiment the primary collector is selected from anionic surface-active compounds such as fatty acids (with an C8 to C24-acyl group), sulfonates, alkyl phosphates, alkyl sulfates and compounds of formula (IV)

(IV)

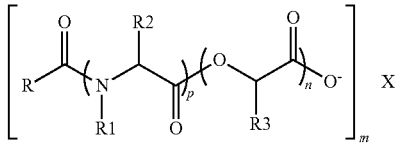

where R is a hydrocarbyl group having from 7-23, preferably 11-21, carbon atoms, optionally substituted; $R_1$ is H or $CH_3$, preferably H; $R_2$ is H or a C1-C4 alkyl group, preferably H; $R_3$ is H or $CH_3$, preferably $CH_3$; n is a number 1-20; p is a number 1-3, preferably 1; X is $H^+$ or a cation which is organic or inorganic, and m represents the valency of the cation and is a number 1-2, preferably 1. The cation is preferably selected from the group consisting of an alkali metal cation, an alkaline earth metal cation, ammonium, and a substituted ammonium group having one or more $C_1$ to $C_3$ alkyl and/or hydroxyalkyl groups.

For the production of compounds of formula (IV) see the description in WO 2015/000931 (corresponding to PCT/EP2014/064014).

In another aspect, the invention relates to a method for froth flotation of non-sulfidic ores, especially phosphate ores, to recover apatite minerals, in which method the collector mixture described above is used.

Such froth flotation method for phosphate ores may typically comprise the steps:

a) conditioning a pulped phosphate-containing ore, wherein the ore comprises a phosphate-containing mineral, and gangue minerals, with an effective amount of the collector composition containing the primary and the secondary collector described herein, and optionally other flotation aids and b) performing a froth flotation process to recover the phosphate-containing mineral(s).

In yet another aspect the invention pertains to a collector composition comprising a primary collector as defined herein and a secondary collector as defined herein.

The weight ratio between the primary collector and the secondary collector is preferably from 15:85, more preferably 20:80, most preferably 25:75 to 99:1, preferably 98:2, most preferably 97:3. All weight ratios herein refer to the ratio of active materials, unless stated otherwise.

The amount of collector composition added to the ore will in general be in the range of from 10 to 1000 g/ton dry ore, preferably in the range of from 20 to 500, more preferably from 100 to 400 g/ton dry ore.

Further flotation aids that may be present in the flotation process are depressants, such as a polysaccharide, alkalized starch or dextrin, extender oils, frothers/froth regulators, such as pine oil, MIBC (methylisobutyl carbinol) and alcohols such as hexanol and alcohol ethoxylates/propoxylates, inorganic dispersants, such as silicate of sodium (water glass) and soda ash, and pH-regulators.

The pH during the flotation process will normally be in the range of 8-11.

The present invention is further illustrated by the following examples.

EXAMPLES

Example 1

Froth Characterization

The froth column is a system of multiple-graduated transparent cylinders of 15 cm of inner diameter. The column is fitted with a variable speed impeller installed on the bottom of the column so that the pulp can be stirred as in a real flotation cell. A metered-air flow enters the column through a tube in the middle of the turbulent zone near the impeller. The slurry volume is set to 1.3 liters and the pulp density is similar to those used in regular flotation tests. The impeller speed and air flow are held constant during tests. The column is also equipped with a linear scale to measure the froth height. The typical test procedure is as follows: (1) conditioning of the collector composition and mineral slurry at pH 11 for 5 minutes; (2) aeration at a constant rate of 3.0 L/min; (3) the froth formation is followed for 10 minutes or until the maximum height is reached and stabilized; and (4) the froth formation and froth breakage is followed by taking pictures every 20 seconds during each process.

The phosphate ore used contained 8% of apatite, 65% phlogopite, 22% carbonate and 5% diabase. The ore was crushed and ground to a desirable flotation size (K80=255 μm).

For all experiments the primary collector used was Atrac 444 (ex Akzo Nobel), which is a mixture of the collector N-[2-hydroxy-3-(C12-16-alkoxy)propyl]-N-methyl glycinate (sodium C14-C15 sarcosinate) and acetic acid, and the respective secondary collectors are given in Table 1 below. 500 g of ore and 0.15 g of a collector mixture were used in each experiment, and in the collector mixture the weight ratio between the primary and the secondary collector was 65:35.

Results

Height of the Froth

TABLE 1

Height of the froth created during the frothing test by the use of different alcohol ethoxylates

| | DB | secondary collector | Type of alcohol | Froth height at pH 11 with mineral and frother (texanol), mm |
|---|---|---|---|---|
| A | 3 | Exxal 13 + 1.5EO | Branched | 320 |
| B | 2.2 | Marlipal O + 1.5EO | Branched | 340 |
| C | NA | Berol 259[1] | Branched/ aromatics | 350 |
| D | 0.6 | Safol 23 + 1.5EO | Mixture (linear/ branched) | 240 |
| E | 0 | Alfol 12/14S + 1.5EO | Linear | 170 |

[1]Berol 259 (ex AkzoNobel) is a nonylphenol ethoxylate with about 2 moles of EO.

All ethoxylated alcohols in the table above have the same degree of ethoxylation (DE), which is defined herein as the amount of moles of ethylene oxide that has been added per mole of alcohol in the ethoxylation reaction. The alcohols Exxal 13 (ex Exxon), Marlipal 0 (ex Sasol), Safol 23 (ex Sasol) and Alfol 12/14S (ex Sasol) were all ethoxylated with 1.5 moles of EO per mole of alcohol.

Several parameters are important when translating laboratory flotation results into the results of large scale flotation. These are type, height and stability of the froth.

Type and height of the froth: Too thin a froth layer usually represents too compact froth consisting of very small bubbles that usually results in an entrainment; therefore it is preferable to have more voluminous froth.

The results in Table 1 above show that the use of branched alcohol ethoxylates as secondary collector provides more voluminous froth (Table 1; A & B), while the use of linear alcohol ethoxylates creates more compact froth (Table 1; D & E).

Stability of the Froth

It is well-known that at a large scale flotation the froth has to collapse as soon as possible after the stop of an air supply. This is a crucial factor at a large scale flotation. As one can see from the results in FIG. 1, the decrease of the froth by the use of the branched alcohol ethoxylates (FIGS. 1. A & B) is much faster than when linear alcohol ethoxylates are used (FIGS. 1. D & E). That means that the use of linear alcohol ethoxylates results in a more stable froth, which will be disadvantageous in the flotation process.

Example 2

General Flotation Procedure

The phosphate ore containing 8% of apatite, 65% phlogopite, 22% carbonate and 5% diabase was crushed and ground to a desirable flotation size ($K_{80}$=255 μm).

Figure 2:
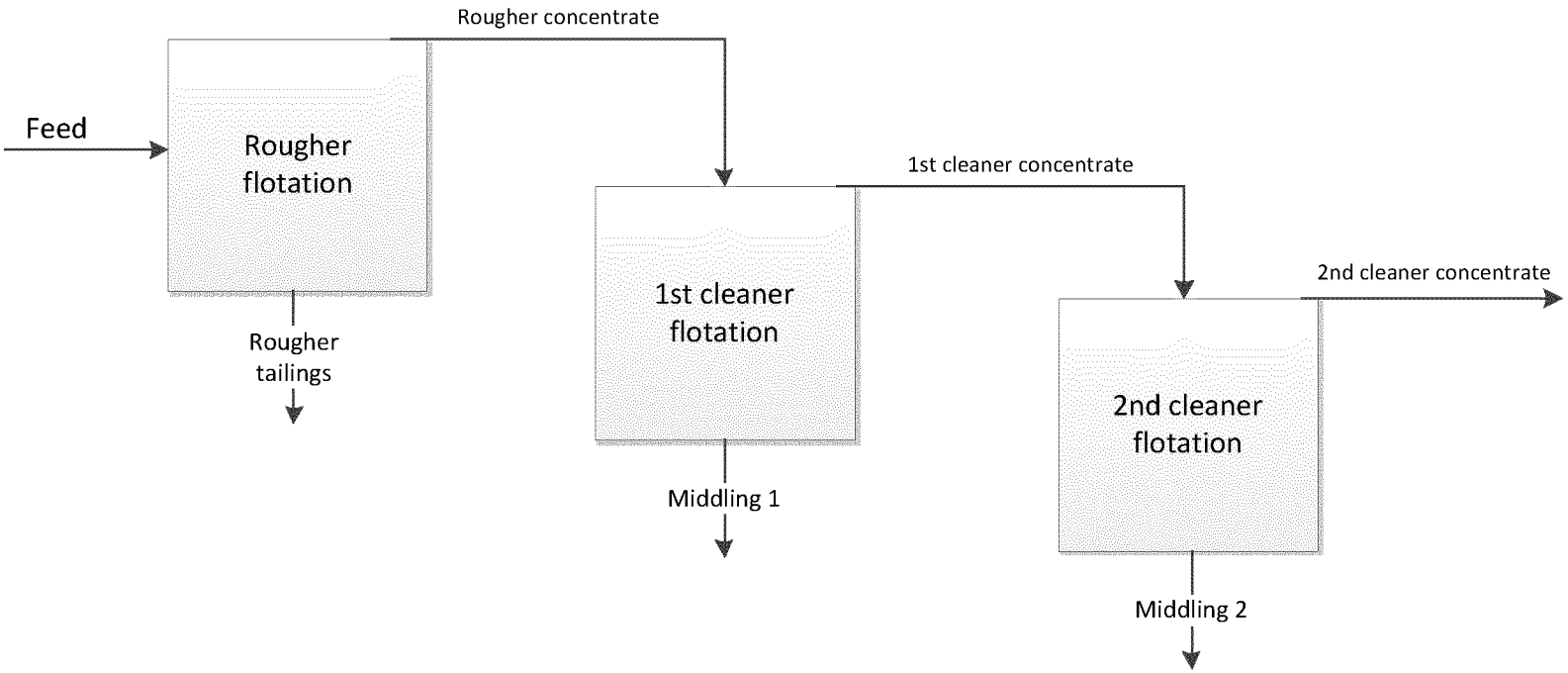
FIG. 2 is a schematic flow chart of a flotation procedure

500 g of the ore was placed into a 1.4 L Denver flotation cell. Tap water (Stenungsund municipal water with hardness 4° dH) was added to the marked level in the cell (1.4 L) and the mixing started. The pH of the flotation mixture was adjusted to 11 with a 5% aqueous NaOH solution and 300 g/t of a mixture of primary and secondary collectors as a 1% aqueous solution was added to the flotation cell. The conditioning was carried out at 1,100 rpm and room temperature for 5 min. After the conditioning step frother was added, and the flotation (900 rpm, 3 L/min) started. The experiment was performed at RT (20±1° C.). The rougher flotation, followed by two cleaning steps was performed. All the fractions (tailings, middlings and concentrate) were collected and analyzed. FIG. 2 is a scheme illustrating the flotation steps performed and the different fractions collected.

The secondary collectors displayed in Table 1 were used in the flotation procedure above, and the flotation results with these collectors are displayed in Table 2. The primary collector used was Atrac 444 (ex Akzo Nobel), which is a mixture of the collector N-[2-hydroxy-3-(C12-16-alkoxy) propyl]-N-methyl glycinate and acetic acid. The weight ratio between the primary and the secondary collector was 65:35.

TABLE 2

Flotation results presented as $P_2O_5$ recovery and grade.

| | | | Rougher concentrate | | 2nd cleaner concentrate | |
|---|---|---|---|---|---|---|
| Code | DB[2] | Secondary collector | Recovery, % | Grade, % | Recovery, % | Grade, % |
| A | 3 | Exxal 13 + 1.5EO | 96.5 | 15 | 81 | 33.5 |
| B | 2.2 | Marlipal O + 1.5EO | 96.5 | 15.5 | 82 | 30.5 |
| C | NA[3] | Berol 259 | 97.6 | 17.1 | 81.8 | 33.0 |
| D | 0.6 | Safol 23 + 1.5EO | 95 | 17 | 45 | 32.5 |
| E | 0 | Alfol 12/14 + 1.5EO | 92 | 21 | 4 | 31.5 |

[2]DB means degree of branching

[3]not applicable; Berol 259 is a nonylphenol ethoxylate with about 2 moles of EO As one can see from Table 2 above, the flotation results are in a good agreement with data obtained from measurements of the froth in Example 1. A more stable froth results in increased losses of apatite during the cleaning steps. The results clearly show that branching plays a crucial role in the flotation. Ethoxylated Safol 23 (that is a mixture of monobranched and linear alcohol) with the primary collector provides already a somewhat improved recovery over ethoxylated fully linear alcohol in a combination with the primary collector. The best performance as a secondary collector is provided by ethoxylated branched alcohols with a DB of 1-3 and by an environmentally less preferred state of the art nonylphenol ethoxylate product.

Example 3

General Flotation Procedure

The phosphate ore containing 20-25% of apatite, 30-40% of silicates and c. 20% of iron oxides was crushed and ground to a desirable flotation size ($K_{80}$=110 μm).

500 g of the ore were placed into a 1.4 L Denver flotation cell, 500 ml of tap water (Stenungsund municipal water with hardness 4° dH) were added and the mixing started. Then 5 minutes conditioning with 1,000 g/ton of a 1% (w/w) aqueous starch solution was performed, 500 g/ton of the collector (or a mixture of primary and secondary collectors) as a 1% (w/w) aqueous solution were added to the flotation cell and conditioning was continued for 2.5 minutes. After the conditioning steps tap water was added so that a total volume of 1.4 L was obtained, the pH of the flotation mixture was adjusted to 9.5 with a 10% NaOH aqueous solution and the flotation was started. The experiment was performed at RT (20±1° C.). The rougher flotation, followed by three cleaning steps, was performed. All fractions (tailings, middlings and concentrate) were collected and analyzed.

TABLE 3

Flotation results presented as $P_2O_5$ recovery at 34% grade.

| | Amount of, g/ton | | |
|---|---|---|---|
| | Lactic acid ester of N-acyl glycine[4] | Exxal 13 + 1.5EO | Recovery at 34% grade of $P_2O_5$, % |
| Comparison | 300 | — | 62.5 |
| Invention | 225 | 75 | 70 |

[4]Acyl group derived from tall oil fatty acid; see detailed description for this product in Example 1 in WO 2015/000931 (PCT/EP2014/064014)

As one can see from Table 3 above, the presence of the secondary collector in accordance with the present invention helps to increase recovery of the apatite by 7.5%. This indicates that this type of secondary collector can be used in the flotation of non-sulfidic minerals together with a broad variety of anionic or amphoteric primary collectors.

Example 4

General Flotation Procedure

A phosphate ore coarse flotation feed sample was used containing 11% of apatite, 69% of calcite, 18% of dolomite, 1% of silicates and 1% of iron oxides. Granulometric size $K_{80}$=350 μm.

400 g of the ore sample were placed into a 2.8 L Denver flotation cell, 800 ml of tap water (Stenungsund municipal water with hardness 4° dH) were added and the mixing started. The pH of the pulp was adjusted to 10.6 with a 10% NaOH aqueous solution. Then after 5 minutes conditioning with 150 g/ton of a 1% (w/w) alkalized aqueous starch solution, 72 g/ton of the collector (mixture of primary and secondary collector) as a 1% (w/w) aqueous solution were added to the flotation cell and conditioning was continued for 2 minutes. After the conditioning steps tap water was added so that a total volume of 2.8 l was obtained, and the flotation was started. The experiment was performed at RT (21±1° C.). Rougher flotation, followed by two cleaning steps in a 1.4 L Denver cell, were performed. All fractions (tailings, middlings and concentrate) were collected, dried and analyzed.

TABLE 4

Flotation results presented as $P_2O_5$ recovery at 36% grade.

| | Amount of, g/ton | | | |
|---|---|---|---|---|
| | Primary collector as in example 2 | Lial 111 (ex Sasol) | Exxal 13 (ex Exxon) | Recovery at 36% grade of $P_2O_5$ (%) |
| Comparison | 47 | 25 | — | 70 |
| Invention | 47 | — | 25 | 88 |

As one can see from Table 4 above, the alcohol Exxal 13 as secondary collector outperforms the alcohol Lial 111. The latter contains mainly undecyl alcohol, 50% is linear, and has a DB<1. Exxal 13 is mainly tridecyl/dodecyl alcohol, 100% is branched, and has a DB of 3.

The invention claimed is:

1. A collector composition comprising:

a surface-active primary collector selected from the group consisting of fatty acids; sulfonates; alkyl phosphates; alkyl sulfates; compounds of the formula (II)

(II)

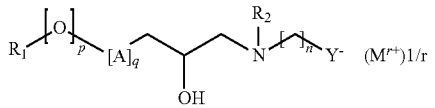

wherein $R_1$ is a hydrocarbyl group having 8-22 carbon atoms, A is an alkyleneoxy group having 2-4 carbon atoms, p is a number 0 or 1, q is a number from 0 to 5, $R_2$ is a hydrocarbyl group having 1-4 carbon atoms or is the group

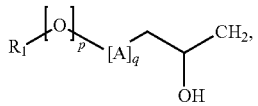

wherein $R_1$, A, p and q have the same meaning as above, $Y^-$ is selected from the group consisting of $COO^-$ and $SO_3^-$, n is a number 1 or 2, M is a cation, which may be monovalent or divalent, and inorganic or organic, and r is a number 1 or 2 or where the compound (II) is in its acidic protonated form without an external cation $(M^{r+})$ 1/r;

compounds of formula (III)

(III)

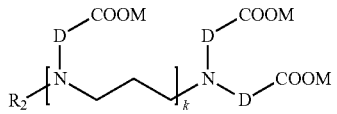

wherein $R_2$ is a hydrocarbyl group with 8-22 carbon atoms, D is —$CH_2$— or —$CH_2CH_2$—, k is a number from 0 to 4, and M is hydrogen or a cation, such as sodium or potassium;

and compounds of formula (IV)

(IV)

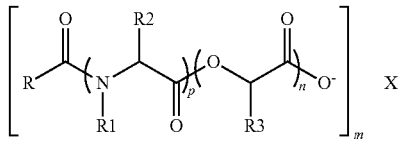

wherein R is a hydrocarbyl group having from 7-23 carbon atoms, optionally substituted, $R_1$ is H or $CH_3$, $R_2$ is H or a C1-C4 alkyl group, $R_3$ is H or $CH_3$, n is a number from 1 to 20; p is a number from 1 to 3, X is $H^+$ or an organic or inorganic cation and m represents the valency of the cation and is a number from 1 to 2; and mixtures thereof; and a secondary collector that is selected from the group of branched fatty alcohol alkoxylates having 12-16 carbon atoms, a degree of branching of 1-3, and a degree of ethoxylation of up to 3 of the formula (I)

$$R—O-(EO)_y,H \quad (I)$$

wherein R is an alkyl or alkenyl group having 12-16 carbon atoms, and wherein said alkyl or alkenyl group has a degree of branching of 1-3, EO is an ethyleneoxy unit, and y is a number from 0 to 3; wherein the weight ratio between the primary collector and the secondary collector is between 15:85 and 99:1.

2. The collector composition according to claim 1 wherein the secondary collector has a degree of branching of 2 to 3.

3. The collector composition according to claim 1 wherein the surface-active primary collector has the formula (III)

(III)

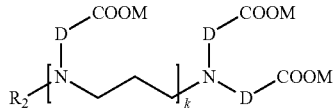

wherein $R_2$ is a hydrocarbyl group with 8-22 carbon atoms, D is —$CH_2$— or —$CH_2CH_2$—, k is a number from 0 to 4, and M is hydrogen or a cation, such as sodium or potassium.

4. The collector composition according to claim 1 wherein the surface-active primary collector has the formula (IV)

(IV)

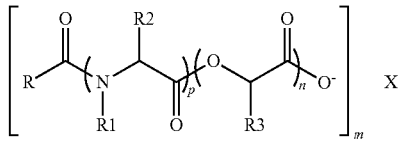

wherein R is a hydrocarbyl group having from 7-23 carbon atoms, optionally substituted, $R_1$ is H or $CH_3$, $R_2$ is H or a C1-C4 alkyl group, $R_3$ is H or $CH_3$, n is a number from 1 to 20; p is a number from 1 to 3, X is $H^+$ or an organic or inorganic cation and m represents the valency of the cation and is a number from 1 to 2; and mixtures thereof.

5. The collector composition according to claim 1 wherein the weight ratio between the primary collector and the secondary collector is between 25:75 and 97:3.

6. The collector composition according to claim 5 wherein the weight ratio between the primary collector and the secondary collector is between about 3:1 and about 2:1.

7. A method of froth flotation of non-sulfidic ores, comprising the steps of:

a) conditioning a pulped phosphate-containing ore, wherein the ore comprises a phosphate-containing mineral, and gangue minerals, with an effective amount of the collector composition of claim 1, and b) performing a froth flotation process to recover phosphate-containing minerals.

* * * * *